US008358794B2

(12) United States Patent
Schulz

(10) Patent No.: US 8,358,794 B2
(45) Date of Patent: Jan. 22, 2013

(54) METHOD FOR SIDE DEFINITION DURING ADJUSTMENT OF HEARING AIDS

(75) Inventor: Herve Schulz, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1273 days.

(21) Appl. No.: 12/001,441

(22) Filed: Dec. 11, 2007

(65) Prior Publication Data

US 2008/0144867 A1 Jun. 19, 2008

(30) Foreign Application Priority Data

Dec. 14, 2006 (DE) ..... 10 2006 059 151

(51) Int. Cl.
*H04R 25/00* (2006.01)

(52) U.S. Cl. ..... 381/314; 381/60; 381/312
(58) Field of Classification Search ..... 381/60, 381/312–318
See application file for complete search history.

(56) References Cited

U.S. PATENT DOCUMENTS

| | | | | |
|---|---|---|---|---|
| 3,221,100 | A * | 11/1965 | Towne | 73/585 |
| 4,107,465 | A * | 8/1978 | Charlebois et al. | 73/585 |
| 5,101,504 | A * | 3/1992 | Lenz | 455/78 |
| 5,870,481 | A | 2/1999 | Dymond et al. | |
| 7,024,000 | B1 * | 4/2006 | Gabara et al. | 381/60 |
| 2004/0042629 | A1 | 3/2004 | Mellone et al. | |
| 2006/0256987 | A1 | 11/2006 | Beilin | |
| 2007/0086600 | A1 * | 4/2007 | Boesen | 381/79 |

FOREIGN PATENT DOCUMENTS

| | | | |
|---|---|---|---|
| EP | 0537026 | B1 | 4/1993 |
| EP | 1562399 | A2 | 8/2005 |

* cited by examiner

*Primary Examiner* — Kenneth Parker
*Assistant Examiner* — John Lin

(57) ABSTRACT

The data records to be stored in the two hearing devices of a binaural hearing system during the adjustment are generally different. With "side definition", the correct assignment of the two hearing devices to the ears or of the wearer is ensured. To this end, an acoustic signal is transmitted to the wearer by way of the receiver of at least one of these hearing devices. The wearer informs the adjusting facility by way of an input device connected hereto, as to the ear with which the wearer heard this acoustic signal or which spatial characteristic or asymmetry is attributed to this acoustic signal.

14 Claims, 2 Drawing Sheets

METHOD FOR SIDE DEFINITION DURING ADJUSTMENT OF HEARING AIDS

CROSS REFERENCE TO RELATED APPLICATIONS

This application claims priority of German application No. 10 2006 059 151.8 DE filed Dec. 14, 2006, which is incorporated by reference herein in its entirety.

FIELD OF INVENTION

The invention relates to a hearing aid, a method to adjust the hearing aid and to a facility for adjusting the hearing aid.

BACKGROUND OF INVENTION

In many cases, a hearing aid with two hearing devices (binaural hearing aid, so-called binaural supply) is necessary or expedient in order to adequately provide assistance to a patient with defective hearing. In such cases digitally programmable hearing systems are nowadays used almost exclusively, in other words hearing systems, the electroacoustic characteristics of which can or must be adjusted externally by way of a computer. The main advantage of (digitally) programmable hearing systems is that a plurality of electroacoustic parameters can be adjusted in order to compensate for the hearing loss in a more precise manner. These hearing devices can use analog signal processing (digitally programmable analog hearing systems) or digital signal processing (fully digital hearing systems). Fully digital hearing devices are hearing systems which convert the analog microphone signal into a digital signal. The digital signal is then processed according to the commands of the programmed software (algorithm) and to the circuitry integrated on the chip. The digital signals are then converted back into analog signals and forwarded to the receiver. The incoming signal is measured here at specific time intervals (signal scanning). The more frequent the signal scanning, the better the reproduction of the input signal. Digitization allows significantly more complex analyses and filterings in respect of an optimum speech/interference noise ratio than was possible with analog systems.

Adjusting facilities (generally by hearing device acousticians) are used for the so-called adjustment of hearing devices, in other words for the adjustment of the parameters thereof (e.g. filter coefficients) or for the programming thereof, said adjusting facilities regularly being embodied as special computers with a special user software running thereupon and exchanging data with the hearing devices, by way of cables or wirelessly, during the adjustment. With the adjustment of binaural (including both ears) hearing aids, a correct assignment of the two hearing devices (HA1, HA2) to the ears (RE) and/or (LE) of the wearer must take place prior to the adjustment, because otherwise the data would be incorrectly assigned to the devices during the adjustment. This assignment of both hearing devices (HA1, HA2) to the ears (RE) and/or (LE) of the wearer for the purpose of the adjustment is also referred to by the person skilled in the art as side definition.

Side definition does not present any problems if the adjusting facility is connected to the hearing device or the hearing devices by way of a cable, because a clear assignment of the ear sides (right and left) to the data is easily possible with the aid of the cable. If the data is transmitted wirelessly between the adjusting facility and the hearing device however, a side definition is less simple.

SUMMARY OF INVENTION

An object underlying the invention is to enable a technically simple side definition. This object is achieved by a method or a product as claimed in one of the claims.

BRIEF DESCRIPTION OF THE DRAWINGS

The invention is described in more detail below with reference to preferred exemplary embodiments and with the aid of figures.

DETAILED DESCRIPTION OF INVENTION

Figure 1:
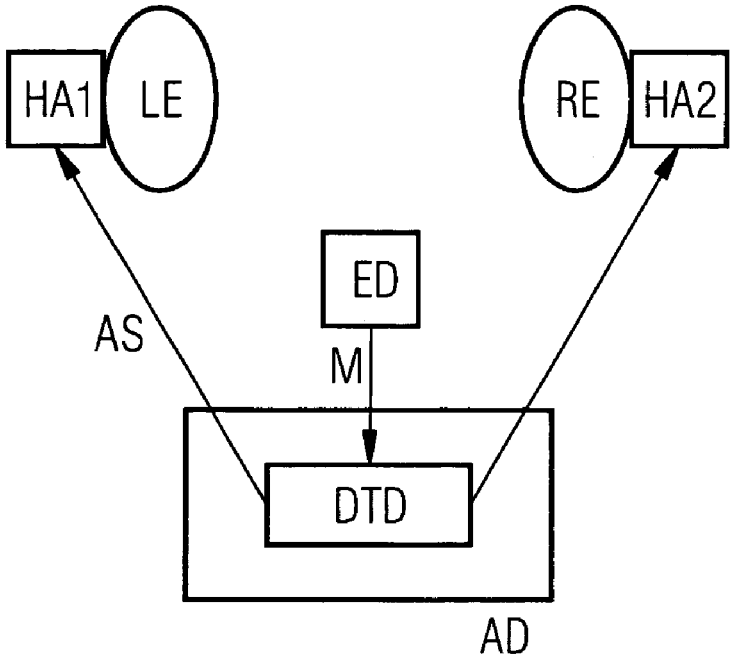
FIG. 1 shows a schematic representation of the interaction of an inventive adjusting facility with the hearing devices of a hearing aid.

FIG. 1 shows a schematic representation of the interaction of an inventive adjusting facility (AD) with the hearing devices (HA1, HA2) of a hearing aid (HA) during the implementation of a method according to the invention.

In this process, a hearing device (HA1, HA2) of the hearing aid (HA) to be adjusted is located on the left (LE) and right (RE) ear in each instance, and the adjusting facility (AD) exchanges data (e.g. filter coefficients or similar data) with at least one of these two hearing devices. The adjustment is finally carried out here by suitable (adjusted to the individual requirements and conditions of the respective ear) data being stored in a storage device of the hearing device, as a result of which a mode of operation of the hearing device which is adjusted to these individual requirements and conditions is effected.

As each of the two ears generally requires an individual adjustment, the data records to be stored in the two hearing devices are generally different. It is thus essential to the success of the adjustment that the data is stored on the correct hearing device in each instance. This is ensured by the side definition, i.e. by the correct assignment of the two hearing devices (HA1, HA2) to the ears (RE) or (LE) of the wearer.

In accordance with the present invention, an acoustic signal (AS) is transferred to the wearer for this purpose by way of the receiver of at least one of these hearing devices, whereupon this wearer informs the adjusting facility (AD) by way of an input device (ED) connected hereto, if necessary communicated by a person operating the adjusting facility, as to the ear in which this acoustic signal was heard by the wearer or which spatial characteristic or asymmetry is attributed to this acoustic signal. In FIG. 1, this input device (ED) is connected to the adjusting facility (AD) by way of a suitable cable for instance. In this case, this can be a conventional computer keyboard or a computer mouse, with the aid of which the wearer of the hearing aid or another person, who is instructed by the wearer, informs the adjustment facility of the notification required for side definition.

The acoustic signal (AS) can be a sine-wave tone for instance, which is only transmitted by way of the receiver of one of the two hearing devices, whereas the other receiver fails to transmit any signal. This can however also be a signal, to which a clearly perceivable spatial characteristic is attributed, in other words a signal representing a moveable sound source for example, which moves from one side to the other. The only crucial thing is that the acoustic signal comprises any side asymmetry which is suited to defining a side.

The acoustic signal (AS) can also be a voice signal, with which the wearer is requested to emit or carry out the notification required for side definition. In accordance with another embodiment variant of the invention, the acoustic signal can contain such a voice signal. An embodiment would also be conceivable in which a noise or a sound moves from one side to the other and a voice signal instructs the wearer of the hearing aid to name the side to which the sound source moves.

Figure 2:
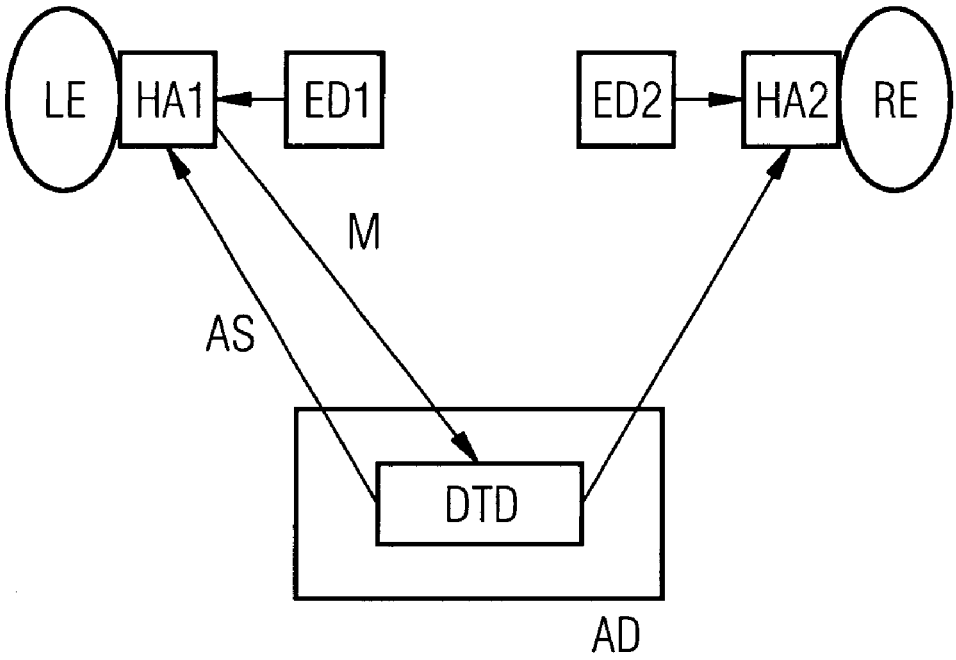
FIG. 2 and FIG. 3 show further schematic representations of the interaction of an inventive adjusting facility with the hearing devices of a hearing aid.
Figure 3:
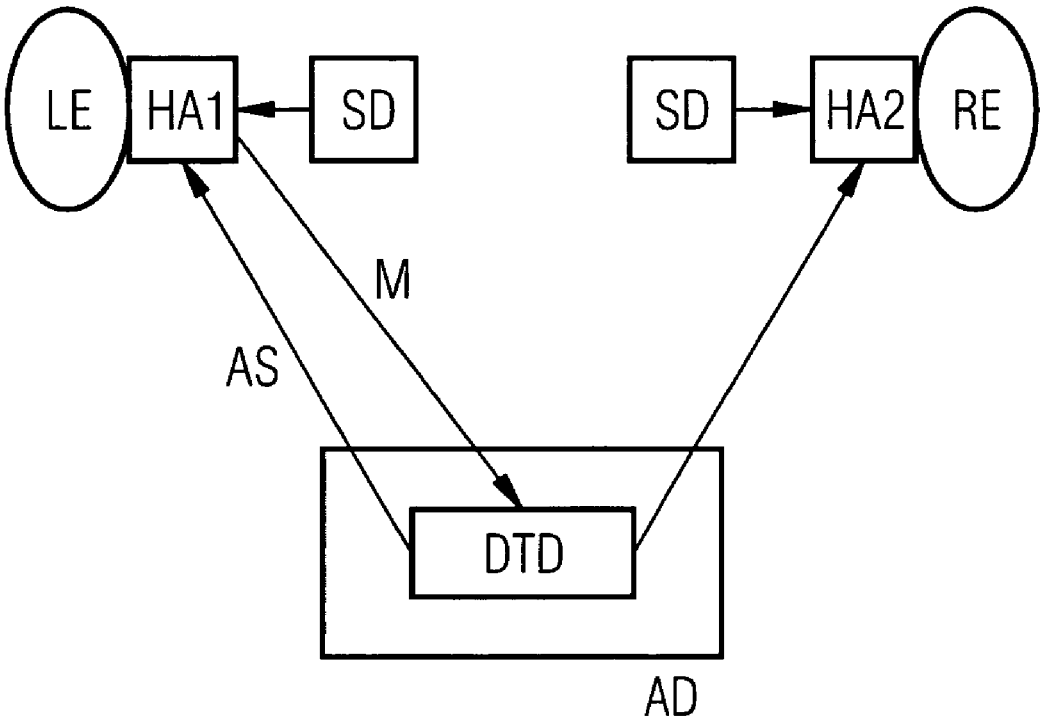

FIG. 2 shows a schematic representation of the interaction of an inventive adjusting facility (AD) with the hearing devices (HA1, HA2) of a hearing aid (HA) during the implementation of an inventive method as claimed in a further embodiment of the invention.

With this embodiment, the facility (ED1) which the user actuates to inform the hearing aid about the information needed for side definition is located in and/or on one of the two hearing devices. This preferably involves a switch which is already located on the hearing device or a corresponding key, which is used in other combinations, e.g. to switch over the hearing program or an operating state of the hearing device and which is/are used in conjunction with the adjustment method as an input device for side definition. The switchover between the meanings of the actuation of this facility can be carried out by way of the software of the adjusting facility for instance.

Instead of operating a switch or suchlike, the wearer of the hearing device can however also touch a sensor, which is located on one of the two hearing devices. This sensor need not necessarily be dedicated to this purpose, but can instead involve an already available metal contact, e.g. a metallic connector socket or suchlike, the capacitance of which changes when it is touched, this being measured by a facility which is present in the hearing device and is accordingly evaluated in the phase of the adjustment and/or side definition and transmitted to the adjusting facility.

Depending on the type of acoustic signal used for side definition, it is possibly necessary or expedient to inform the wearer of the hearing aid as to the manner in which he/she is to emit or carry out the notification. If the signal represents a sound source which moves from the left to the right ear, it is unclear from the outset whether the wearer is to carry out the notification required for side definition by naming the original site (left ear) or the target site (right ear) of the sound source. An arrangement between the examining person (generally a hearing device acoustician) and the examined person (the wearer of the hearing aid) is obviously needed to ensure a clear assignment. The arrangement can advantageously be made by the wearer of the hearing aid also being notified by way of the voice signal as to the manner in which he/she is to emit or carry out the notification. In the example shown, the voice signal could thus contain the text "Please touch the sensor on the hearing device from which you initially hear the sound source" or suchlike.

It is of no significance for the invention whether the input device is in contact with the adjusting facility by way of a wireless, optical or electrical connection. Nor is it of significance whether the input device is directly operated by the wearer of the hearing aid or by an examiner, who the wearer of the hearing aid verbally notifies about information required for the side definition. The input device can then be located on and/or in a hearing device, but can also be an integral part of the adjusting facility or its accessories.

The invention claimed is:

1. A method for adjusting a hearing aid, wherein the hearing aid has two hearing devices comprising a right hearing device for a right ear and a left hearing device for a left ear, wherein an adjusting device wirelessly exchanges data with at least one of the hearing devices, the method comprising:

transmitting an acoustic signal asymmetrically to the hearing aid such that the acoustic signal is received at a receiver of only one of the hearing devices at a time, the acoustic signal used for a correct assignment of the two hearing devices to the ears of a wearer of the hearing aid for a correct side definition based on a side asymmetry of the acoustic signal;

receiving by the adjustment device via an input device a notification of which ear of the wearer received the acoustic signal based on the side asymmetry of the acoustic signal; and based on the notification, effecting the correct side definition of the two hearing devices to allow for data to be wirelessly transmitted and stored on a correct hearing device during adjustment of the hearing aid.

2. The method as claimed in claim 1, wherein the input device is connected to the adjustment device.

3. The method as claimed in claim 2, wherein the wearer tells a person operating the adjustment device which ear received the acoustic signal.

4. The method as claimed in claim 1, wherein the input device is located in or on one of the two hearing devices.

5. The method as claimed in claim 1, wherein the input device is a sensor to sensor sense a touch, wherein the sensor is located on a hearing device.

6. The method as claimed in claim 1, wherein the acoustic signal has a voice signal, wherein the notification for the correct side definition is requested from the wearer via the voice signal.

7. The method as claimed in claim 1, wherein the side asymmetry of the acoustic signal comprises a moveable sound source which moves from one hearing device to the other to provide a perceivable spatial characteristic.

8. The method as claimed in claim 6, wherein the wearer is notified by way of the voice signal how to make the notification.

9. A hearing aid, comprising:

two hearing devices, comprising a right hearing device for a right ear and a left hearing device for a left ear;

wherein at least one of the hearing devices and a adjusting facility are connectable via a wireless data connection for exchanging data, the data comprising an acoustical signal transmitted asymmetrically from the adjusting facility to the hearing aid such that the acoustic signal is received by a receiver of only one of the hearing devices at a time, the acoustic signal used for a correct assignment of the two hearing devices to the ears of a wearer of the hearing aid for a correct side definition based on a side asymmetry of the acoustic signal, wherein at least one of the hearing devices has a sensor, to be touched by a user to notify the adjusting facility about an assignment of the two hearing devices to the two ears of the wearer to provide an indication of the correct side definition based on the side asymmetry of the acoustic signal, the adjusting facility effecting the correct side definition of the two hearing devices to allow for data to be wirelessly transmitted and stored on a correct hearing device during adjustment of the hearing aid.

10. The hearing aid as claimed in claim 9, wherein the side asymmetry of the acoustic signal comprises a moveable sound source which moves from one hearing device to the other to provide a perceivable spatial characteristic.

11. A method for adjusting a hearing aid, wherein the hearing aid has a right hearing device for a right ear and a left hearing device for a left ear, comprising:

providing an adjusting device, wherein the adjusting device wirelessly exchanges data with at least one of the hearing devices;

transmitting an acoustic signal asymmetrically to the hearing aid such that the acoustic signal is received by a receiver of only one of the hearing devices at a time for a correct assignment of the two hearing devices to the ears of a wearer of the hearing aid based on a side definition in accordance with the side asymmetry of the acoustic signal;

notifying the adjustment device via an input device connected to the adjustment device about the side asymmetry attributed to the acoustic signal; and based on the notification, effecting the correct side definition of the right and left hearing devices to allow for data to be wirelessly transmitted and stored on a correct hearing device during adjustment of the hearing aid.

12. The method as claimed in claim 11, wherein the wearer tells a person operating the adjustment device which ear received the acoustic signal.

13. The method as claimed in claim 12, wherein the side asymmetry is based on a spatial characteristic.

14. The method as claimed in claim 11, wherein the side asymmetry of the acoustic signal comprises a moveable sound source which moves from one hearing device to the other to provide a perceivable spatial characteristic.

* * * * *